United States Patent [19]

Houle et al.

[11] Patent Number: 5,035,992

[45] Date of Patent: Jul. 30, 1991

[54] PROCESS FOR THE STABILIZATION OF HIGH-CHLORIDE CRYSTALS WITH MODIFIED CRYSTAL HABIT USING BROMIDE SHELLS

[75] Inventors: William A. Houle, Kimberton, Pa.; Thomas P. Tufano, Hockessin, Del.

[73] Assignee: E. I. Du Pont de Nemours and Company, Wilmington, Del.

[21] Appl. No.: 443,547

[22] Filed: Nov. 30, 1989

[51] Int. Cl.[5] ..... G03C 1/02; G03C 1/34

[52] U.S. Cl. ..... 430/569; 430/567

[58] Field of Search ..... 430/569, 567

[56] References Cited

U.S. PATENT DOCUMENTS 4,783,398 11/1988 Takada et al. ..... 430/567
4,801,523 1/1989 Tufano ..... 430/589
4,804,621 2/1989 Tufano et al. ..... 430/567

*Primary Examiner*—Charles L. Bowers, Jr.
*Assistant Examiner*—Thorl Chea

[57] ABSTRACT

Process for stabilizing the crystalline grain morphology of silver halide grain cores prepared in the presence of a dispersing medium and an aminoazapyridine compound at a pH of 2.5 to 9 and pCl of 0 to 3, at least 50% of the total projected area of the total grain population being noncubic silver halide grain cores and the halide content being at least 50 mole percent chloride, based on total moles of silver precipitated, the improvement wherein after 60% of aqueous silver salt solution based on the total moles of silver precipitated is introduced a second halide salt, e.g., bromide, is added thereby forming on the grain cores a shell of 0.5 to 20 mole % based on the total moles of silver precipitated. The emulsions are useful in X-ray, color separation, inverse transfer films, and "dry-silver" applications, etc.

15 Claims, 8 Drawing Sheets

F I G. 1

1 μm

PROCESS FOR THE STABILIZATION OF HIGH-CHLORIDE CRYSTALS WITH MODIFIED CRYSTAL HABIT USING BROMIDE SHELLS

FIELD OF THE INVENTION

This invention relates to a new process for the stabilization of the microcrystalline grains of a radiation-sensitive photographic silver halide emulsion. More particularly, this invention relates to a process for the morphological stabilization of the microcrystalline grains of a silver halide emulsion having silver halide grains wherein at least 50% of the total grain population possess a well-defined noncubic crystalline shape and the halide content of the silver halide emulsion is at least 50 mole percent chloride based on the moles of silver present.

BACKGROUND OF THE INVENTION

Photographic elements made predominantly of silver chloride, with minor amounts of silver bromide and iodide (e.g., >70 mole % chloride), are well known in the prior art. One major advantage of silver chloride over other photographically-useful silver halides is that it possesses greater aqueous solubility and thus allows for more rapid processing of exposed elements. However, since silver chloride-containing elements exhibit in general lower photographic speed than those containing mainly silver bromide, the use of such elements has been limited to graphic arts applications (e.g., contact, low-speed camera films, etc.). It would be desirable to use the significant benefit of rapid processibility in many of the silver halide art fields where chloride-rich emulsions are not already commonly employed because of photographic speed limitations.

It is also well known in the art that silver chloride strongly favors the formation of cubic crystals having {100} crystal faces. In the majority of photographic emulsions, silver chloride crystals when present are in the form of cubic grains. With some difficulty it has been possible to modify the crystal habit of silver chloride. Claes et al., "Crystal Habit Modification of AgCl by Impurities Determining the Solvation", The Journal of Photographic Science, Vol. 21, pp. 39–50, 1973, teaches the formation of silver chloride crystals with (110) (rhombic dodecahedral) and {111} (octahedral) faces through the use of various grain growth modifiers. Wyrsch, in "Sulfur Sensitization of Monosized Silver Chloride Emulsions with {111}, {110}, and {100} Crystal Habit", Paper III-13, International Congress of Photographic Science, pp. 122–124, 1978, discloses a triple-jet process in which silver chloride emulsions characterized by grains of modified growth habit are precipitated in the presence of ammonia and small amounts of divalent cadmium ions.

Tabular grain silver halide products are also known in the prior art and present the user with some considerable advantages over conventional grain products, e.g., those products having semi-spheroidal grains. The tabular products exhibit higher covering power, improved sharpness, can be more effectively spectrally sensitized, are more easily developed and can tolerate a higher level of hardening without loss in covering power, each providing quite an advantage over conventional grains.

There are now several methods available for making tabular grain high-chloride emulsions. Wey U.S. Pat. No. 4,399,215 discloses the use of ammonia under prescribed pH and pAg conditions to produce large, thick tabular chloride grains. Wey and Wilgus U.S. Pat. No. 4,414,306 discloses a process for tabular grain silver chlorobromide growth which relies on precise control of the molar ratio between chloride and bromide ions; however, the chloride content of the emulsion grains so produced is limited to no more than 40 mole percent. In Maskasky U.S. Pat. No. 4,400,463, high-aspect-ratio tabular grain formation is carried out in the presence of a growth modifying amount of an aminoazaindene and a synthetic peptizer having a thioether linkage used in place of gelatin. Maskasky U.S. Pat. No. 4,713,323 describes a process for precipitation of tabular grain high-chloride emulsions using a dispersing medium composed of a gelatino-peptizer having no more than 30 micromoles of methionine per gram and at least a 0.5 molar concentration of chloride ion. In Takada et al. U.S. Pat. No. 4,783,398, a large class of sulfur-containing heterocyclic compounds are disclosed as growth modifying agents for the precipitation of tabular high-chloride emulsion grains.

Two recent U.S. Pat. Nos. Tufano 4,801,523 and Tufano and Chan 4,804,621, describe processes for the precipitation of {111} octahedral and tabular grain chloride-rich emulsions. A specific class of aminoazapyridine growth modifiers is used to produce well-formed, noncubic emulsion microcrystals in a conventional gelatin growth medium. Since these growth modifiers exhibit acid-base behavior over a pH range commonly employed for silver halide precipitation (e.g., pH 2.5–9), the pH of the growth medium is important to obtain the desired grain morphology. It has now been discovered that the emulsion grains produced by these processes show signs of morphological instability during typical emulsion preparation steps after precipitation in the absence of the grain growth modifier. That is, under emulsion conditions where the surface-adsorbed growth modifier may desorb, e.g., pH <2.5, and wash free of the emulsion grains, chloride-rich {111} octahedral and tabular grains may, through a ripening process, deform and revert to the more thermodynamically stable {100} cubic form. Thus if unchecked, much of the advantages of the noncubic high-chloride grains, i.e., unique sensitizability of the {111} high-chloride surface, high covering power, etc., are lost in the final photographic element itself. Therefore there is a need to more effectively stabilize noncubic emulsion grains during preparation steps subsequent to precipitation, wherein the grains are formed in the presence of a pH-sensitive grain growth modifier, and at least 50 mole percent of the grains of the emulsion are chloride to provide photographically useful emulsions.

An object of this invention is to provide a method to morphologically stabilize {111} noncubic chloride-rich grain types so as to prevent ripening to the {100} cubic form.

Another object of this invention is to provide a method to morphologically stabilize {111} noncubic emulsion grains without requiring the presence of a grain growth modifier during emulsion preparation steps subsequent to precipitation thus providing an emulsion having greater sensitization latitude.

A further object of the invention is to provide a method for introducing a shell onto a chloride-rich silver halide grain core without compromising the well-defined {111} surface structure or resulting in epitaxial deposition, or re-seeding.

Still another object of the invention is to provide a silver halide photographic emulsion with the combined advantages of the rapid processibility of chloride-rich grains and the spectral and chemical sensitizability of bromide-rich grains with little or no disadvantages of either.

SUMMARY OF THE INVENTION

In accordance with this invention there is provided a process for stabilizing the crystalline grain morphology of a radiation sensitive photographic emulsion by bringing into contact in a vessel in the presence of a dispersing medium and a crystal modifying amount of an aminoazapyridine growth modifying agent at a pH in the range of 2.5 to 9.0 and a pCl in the range of 0 to 3 aqueous silver and chloride-containing salt solutions to precipitate silver halide grain cores wherein at least 50% of the total projected area of the total grain population precipitated are noncubic silver halide grain cores, and wherein the halide content of the silver halide emulsion is at least 50 mole percent chloride, based on the total moles of silver precipitated, the improvement wherein subsequent to the addition of at least 60 percent of the aqueous silver salt solution to the vessel based on the total moles of silver precipitated introducing at a gradual rate of addition a second halide salt solution which is non-chloride-rich forming on the silver halide grain cores a shell of 0.5 to 20 mole % based on the total moles of silver precipitated.

BRIEF DESCRIPTION OF THE DRAWINGS

The advantages of this invention can be best appreciated by consideration of the following drawings in combination with the selected controls and examples and the detailed descriptions of the preferred embodiments.

In FIG. 1 the emulsion is sampled immediately after the completion of the precipitation reaction. In FIG. 2 the emulsion is sampled after the emulsion preparation steps of desalting, redispersion and digestion.

In FIG. 3 the emulsion is sampled immediately after precipitation. In FIG. 4 the emulsion is sampled after typical emulsion preparation steps required to make a sensitized, coated film.

In FIG. 5 the emulsion is sampled immediately after precipitation. In FIG. 6 the emulsion is sampled after typical emulsion preparation steps required to make a sensitized, coated film.

In FIG. 7 the emulsion is sampled immediately after precipitation. In FIG. 8 the emulsion is sampled after typical emulsion preparation steps required to make a sensitized, coated film.

DESCRIPTION OF PREFERRED EMBODIMENTS

Figure 1:
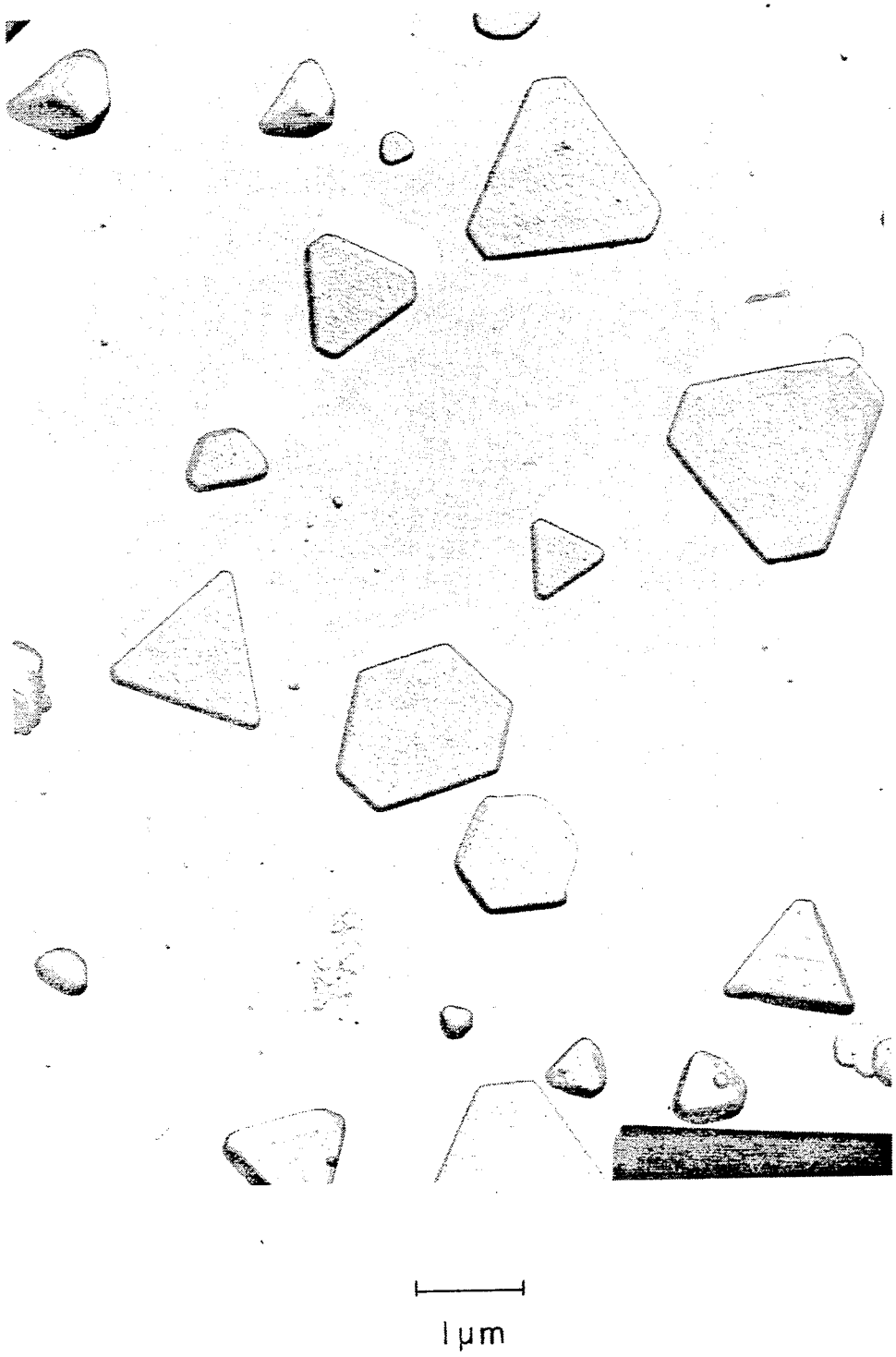
FIG. 1 and FIG. 2 are representative transmission electron micrograph (TEM) photographs (magnification 15,500 and 15,750, respectively) of carbon-replicated tabular silver chloride grains prepared according to Control 1 of this invention.

Throughout the specification the below listed terms have the following meanings:

"High-chloride" or "chloride-rich" emulsion grains refers to silver halide emulsion microcrystals whose chloride content is greater than or equal to 50 mole percent based upon the total moles of silver precipitated in the emulsion.

"Noncubic" with respect to silver chloride-containing grains means those octahedral shaped grains whose exterior crystal faces are well-defined and lie in {111} crystallographic planes and are normal to axes of trigonal symmetry, and tabular shaped grains with substantially parallel major {111} crystal faces.

As employed herein the term "tabular" means that silver halide grains have a thickness of less than 0.5 μm, preferably less than 0.3 μm a diameter of at least 0.2 μm, an average aspect ratio of greater than 2:1, and account for a least 50 percent of the total projected area of the silver halide grains present in the emulsion.

The grain shape characteristics described above for the silver halide emulsions of this invention can be readily ascertained by procedures well known to those skilled in the art. As employed herein, the term "aspect ratio" refers to the ratio of the diameter of the grain to its thickness. From shadowed electron micrographs of emulsion samples, it is possible to determine the diameter and thickness of each grain. The diameter of a tabular grain refers to the diameter of a circle equal in area to the projected area of the grain. Generally, a tabular grain has two major parallel crystal faces and therefore the thickness refers to the distance between the two parallel faces constituting the tabular grain. Thus, we can identify those tabular gains having a thickness of less than 0.5 μm (or 0.3 μm) and a diameter of at least 0 2 μm. From this the aspect ratio of each such tabular grain can be calculated, and the aspect ratios of all the tabular grains in the sample meeting the thickness and diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.5 μm (or 0.3 μm) and a diameter of at least 0.2 μm and to calculate the average aspect ratio as the ratio of these two averages. The average diameter of the grains is typically determined from their average area by assuming that said area is the ratio of the median volume (as measured independently by a conventional Electrolytic Grain Size Analyzer - EGSA) and from the average thickness as determined from the aforesaid electron micrograph described above. Whether the averaged individual aspect ratios or the averages of thickness and diameter are used to determine the average aspect ratio, within the tolerance of grain measurements contemplated, the average aspect ratios obtained do not significantly differ. The projected areas of the silver halide grains meeting the thickness and diameter criteria can be summed, the projected areas of the remaining silver halide grains in the photomicrograph can be summed separately, and from the two sums the percentage of the total projected area of the silver halide grains provided by the grains meeting the thickness and diameter criteria can be calculated.

Morphologically stable with respect to silver chloride-containing grains means those grains which maintain their grain crystalline shape and size during steps in photographic emulsion preparation subsequent to the formation of the grains at precipitation.

The noncubic grain characteristics described above for the silver chloride-containing emulsions prepared by this invention can be ascertained by examining shadowed electron micrographs of these emulsions. At least 50% of the total grain population stabilized by this invention are noncubic in shape and preferably about 90% or greater are noncubic in shape.

In the context of this invention, a "shell" refers to a localized surface layer of silver halide deposited in a continuous fashion on a pre-formed silver halide grain core. A "core" refers to the said pre-formed silver halide grain onto which the shell is formed. The halide composition of the shell and core regions of the grain are of different composition (thus distinguishing the shell from the core) by controlling the halide composition of the halide salt solutions used in the precipitation. The shell is formed after at least 60 percent, preferably at least 90 percent, of the grain formation reaction is complete, based upon the total moles of silver precipitated. Alternatively, the shell may be formed after all of the silver salt solution has been added by the addition of a second halide salt solution, wherein the solubility with silver ion of the second halide is sufficiently less than that of the first halide so that conversion of the surface silver halide layer will result.

Silver chloride-containing grains which are noncubic in shape are formed by the addition of a pH sensitive aminoazapyridine grain growth modifier present in an amount of 0.0001 to 1.0 mole percent, preferably 0.05 to 0.5 mole percent, based on the total moles of silver precipitated. Suitable aminoazapyridine compounds are described in U.S. Pat. Nos. 4,801,523 and 4,804,621, the disclosures of which are hereby incorporated by reference.

Grain growth modifying agents useful within the ambit of this invention are based on the following, generic structure:

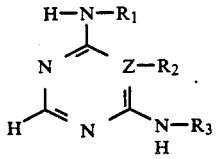

wherein Z is C or N; $R_1$, $R_2$ and $R_3$, which may be the same or different, are H or alkyl of 1 to 5 carbon atoms; when Z is C, $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together is said $—CR_4{=}N—$, $—CR_4{=}$ must be joined to Z; and salts thereof.

Some of the more useful compounds which fall within this generic structure include, but are not limited to:

4-aminopyrazolo[3,4,d]pyrimidine
4,6-diaminopyrimidine
2,4-diamino-l,3,5-triazine
4,6-bis(methylamino)pyrimidine.

The noncubic grains formed by the processes disclosed in the aforementioned two patents show signs of morphological instability in the absence of a grain growth modifier. The grain growth modifier which forms and stabilizes the grain, may be desorbed from the grain surface and washed away when the emulsion grains undergo pH changes (e.g., < pH 2.5) during emulsion preparation steps subsequent to the growth phase of precipitation, such as in emulsion concentration and washing. Without the influence of the grain growth modifier in the emulsion, the grains revert to the thermodynamically stable form, i.e., that of a cubic crystalline shape. More frequently it is observed that the crystalline emulsion grains deform to an intermediate state, that being characterized by irregularly shaped crystalline grains. Thus much of the advantages of a high-chloride noncubic grain with well-formed {111} crystal surfaces are lost to the final photographic element.

In the preparation of the radiation-sensitive photographic emulsions, silver chloride-containing grain cores can be prepared by standard balanced-double-jet (BDJ) procedures such as are illustrated in the examples below or as known to those skilled in the art. The emulsion's halide content is at least 50 mole percent chloride, based on the total moles of silver precipitated. Amounts of bromide and/or iodide may be present. The mole percent of bromide can range up to 49 and the mole percent of iodide up to 2, based on the total moles of silver precipitated. The emulsions when made by the conventional BDJ procedure utilize solutions consisting essentially of the halide salt, e.g., chloride or chloride, bromide, and optionally iodide in small amount, and one containing the silver salt are added simultaneously to a solution of dispersing medium such as gelatin, etc. in a suitable reaction vessel. Conventionally, small amounts of the halide solution may also be present in the vessel. By controlling the pH, e.g., 2.5 to 9, preferably 3.5 to 8; pCl, e.g., 0 to 3, preferably 0.3 to 1.7; temperature, the rate of addition of the two solutions into the vessel, and the amount and time of addition of a selected growth modifying agent, one having ordinary skill in the art can generally predict the characteristics of the noncubic silver halide grains prepared.

A silver halide shell is preferably formed on the silver chloride-rich noncubic grain cores by a graded profile addition of a second halide salt solution which is nonchloride-rich and which can be bromide, iodide, chlorobromide, and combinations thereof. The silver halide shell is preferably bromide, formed during the final stages of grain precipitation. The graded profile addition of the halide which forms the shell on the noncubic grain cores begins after about 60%, preferably after about 90%, of the grain precipitation reaction is complete, as is determined by the total moles of silver precipitated in the reaction vessel. The second or shell-forming halide salt solution is gradually added with mixing to the chloride-containing salt solution which forms the core of the grain, thus the composition of the halide salt solution mixture continuously changes, decreasing in core-forming halide salt concentration, and increasing in shell-forming halide salt concentration. Further, the halide salt solution mixture is simultaneously added to the precipitation vessel to feed the grain formation reaction. The rate at which the second halide salt solution is added is based on having the concentration of the second halide salt solution in the halide salt solution mixture change from 0% to 100% during the time remaining to complete the silver salt addition to the grain formation reaction. The amount of second halide salt solution added during this time period is easily determined by one skilled in the art since, for optimum use of materials, all of the silver salt solution must react with a halide salt solution. The amount of the shell-forming halide is 0.5 to 20 mole %, preferably 1 to 5 mole %, based upon the total moles of silver precipitated. The graded profile addition of a second halide, which builds the shell surrounding the grain core and gradually changes in halide composition, prevents epitaxial growths on, or other irregular distortions of, the grain surface. Epitaxy is a phenomenon in which the growth of one crystal occurs on the surface of another crystal and is oriented by the lattice structure of the substrate.

A silver halide shell may also be formed on silver chloride-rich noncubic grain cores by the gradual addition of a second halide salt solution, as described above, immediately after the completion (100% complete) of the grain formation reaction. In this embodiment, the grain formation reaction is complete as all the silver salt solution and core-forming halide solution have been added to the reaction vessel. Immediately thereafter, the shell-forming halide solution is gradually added in a single-jet (SJ) fashion to the preformed noncubic grain emulsion. The amount of the shell-forming halide is 0.5 to 20 mole %, preferably 1 to 5 mole %, based upon the total moles of silver precipitated. The shell-forming halide salt solution is added at a sufficiently reduced rate so that distortion of the well-defined (111) grain surfaces does not occur. The gradual rate of addition of the shell-forming halide salt solution is 0.01 to 0.5 times, preferably 0.05 to 0.2 times, the maximum rate of addition of the silver salt solution used during the grain formation reaction. Nearly complete incorporation of the shell-forming halide is accomplished provided that the thermodynamic stability of the shell-forming halide with silver ion is sufficiently greater than that of the core-forming halide. For example, the difference in solubility of silver bromide and silver chloride is large enough to ensure nearly quantitative exchange of bromide ion for chloride ion in a shell-forming process. Additionally, to ensure quantitative incorporation of the shell-forming halide material, the reaction mixture is ripened with stirring for a period of time, e.g., 10 to 30 minutes, after addition of the shell-forming halide salt solution is complete.

A silver halide shell may be formed by yet another method on silver chloride-rich noncubic grain cores by the controlled double-jet addition of the silver salt solution and the shell-forming second halide salt solution. The shell, which is of the composition as described above, is formed after at least 80% of the total grain formation reaction is complete, based on the total moles of silver precipitated, and after the addition of the core-forming halide salt is stopped. The amount of the shell-forming halide is 0.5 to 20 mole % preferably 1 to 5 mole %, based upon the total moles of silver precipitated. The silver and shell-forming halide salt solutions are added at sufficiently reduced rates so that distortion of or epitaxial deposition upon the well-defined (111) grain surfaces does not occur. The rate of double-jet addition of the silver and shell-forming halide salt solutions is 0.01 to 0.5 times, preferably 0.05 to 0.2 times, the maximum rate of addition of the silver salt solution used during the core-forming grain formation reaction.

The overall halide composition of the grain (core and shell) may include combinations of chloride with bromide, and/or iodide. The overall halide composition must be consistent with the desires for an emulsion halide content of at least 50 mole % chloride based on the total moles of silver precipitated. In addition, a maximum of 49 mole % bromide and a maximum of 2 mole % iodide, in the overall halide composition, based on the total moles of silver precipitated is desired. The shell-forming halide may include bromide, iodide, chlorobromide and combinations thereof. The preferred major halide constituent of the shell is bromide.

INDUSTRIAL APPLICABILITY

The emulsions prepared by this invention can be used to prepare photographic film elements in any of the conventional areas. These films can be used, for example, in the field of X-ray, as color separation elements, as laser scanner films, inverse transfer systems, or in "dry-silver" applications. When properly sensitized and treated with color-forming agents in the conventional and well-known manner, films useful as color negatives or positives can be made with the noncubic grains of this invention.

EXAMPLES

In the examples and controls which follow, and which are used to demonstrate the efficacy and breadth of this invention without limitation and wherein the percentages are by weight, Examples 1 and 3 are considered to be preferred modes of the invention.

CONTROL 1

This control illustrates how {111} tabular high-chloride grains, produced using a pH-sensitive crystal growth modifying agent can deform away from good tabular morphology during emulsion preparation steps subsequent to precipitation (i.e., desalting, redispersion, and digestion) when not stabilized by the process of this invention.

The following ingredients were placed in a suitable reaction vessel:

| Ingredient | Amount (g) |
|---|---|
| 10% Aqueous Gelatin | 80 |
| KCl | 7.46 |
| 4-aminopyrazolo[3,4,d]pyrimidine | 0.082 |
| Deionized water | 420 ml |

The pH was adjusted to 4.0 with 1.5 M sulfuric acid and the above ingredients were stirred and heated to 60° C. In separate vessels, aqueous solutions of 3.0 M $AgNO_3$ (the silver salt solution) and 3.0 M KCl (the halide salt solution) were prepared. A pump was used to meter each of these solutions into the reaction vessel. To generate seed crystals, the silver and halide streams were "double-jetted" into the vessel in such a way as to maintain a constant chloride concentration (pCl=0.7). After ca. 11% of the silver salt solution had been added, the silver flow rate was increased to twice the initial seeding level, while adjusting the halide flow rate to maintain a constant excess chloride ion concentration. This was maintained until 100 ml of the silver solution was used (0.3 mole). The total precipitation time was 25 minutes. The resulting AgCl grains were examined using optical and electron microscopy to determine grain thickness and shape. An electrolytic grain size analyzer (EGSA) was used to determine grain volume (0.32 $\mu m^3$ volume-weighted. Excellent tabular grains were formed (average thickness 0.20 $\mu$m, average aspect ratio 7.1:1) as shown by the electron micrograph photograph in FIG. 1.

Figure 2:
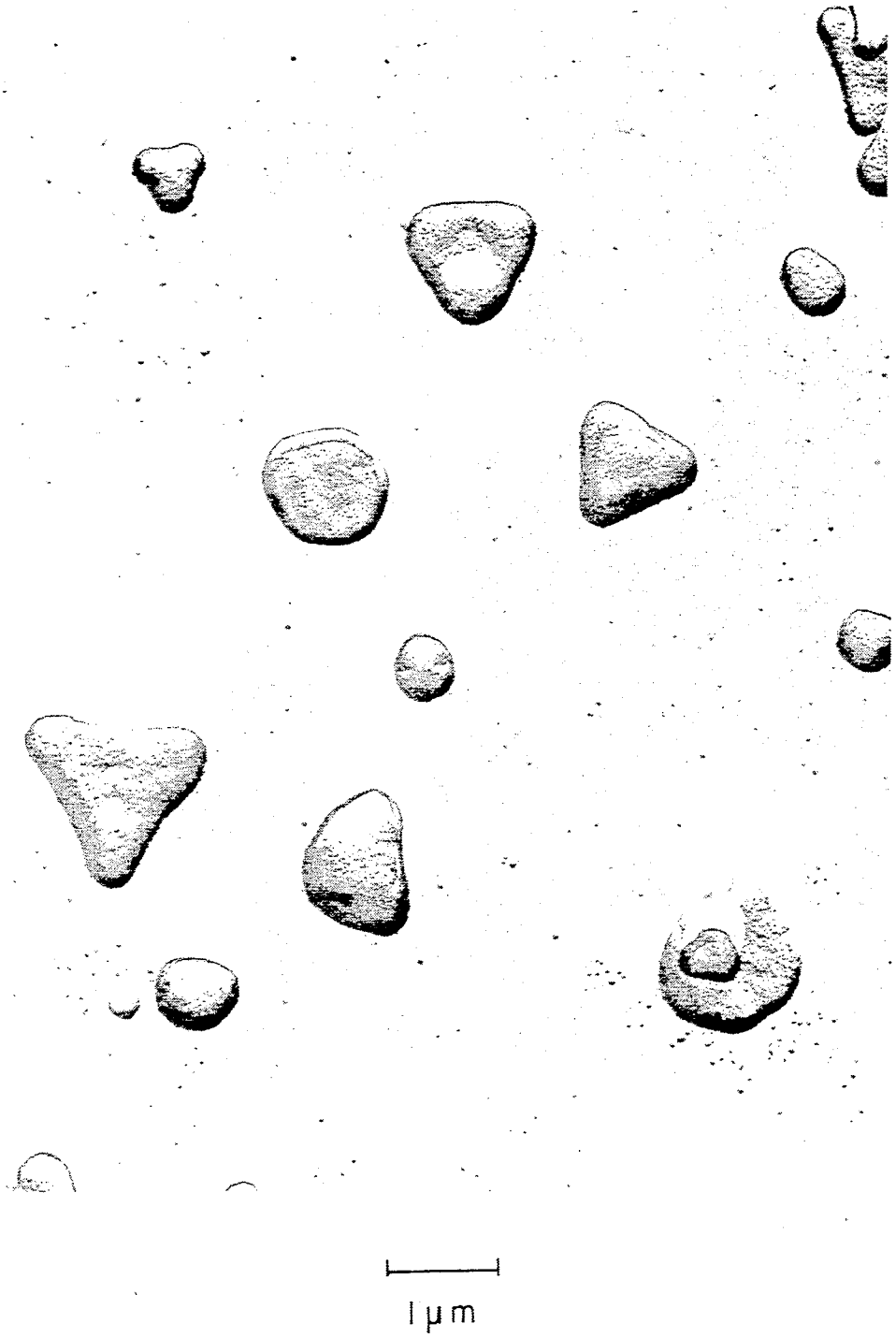

The tabular grains thus formed were washed free of excess salts, concentrated, and then mixed in water and bulk gelatin at ca. 40° C and pH 6.0 for 45 minutes to redisperse the grains therein. The redispersed material was then chemically and spectrally sensitized using a conventional scheme and digested for a total of 60 minutes at ca. 50° C. A sample of this material was then taken to examine the grains therein as described above. As the electron micrograph photograph in FIG. 2 illustrates, good tabular crystal shape is not preserved. The crystals have an average thickness of 0.63 μm and an average aspect ratio of 1.3:1.

EXAMPLE 1

In this example stabilization of tabular crystal morphology through the steps required to produce a gold and sulfur sensitized coated film is demonstrated by gradually increasing the bromide concentration of the grain near the end of the precipitation process in such a way to produce a graded profile of bromide at the grain surface. Tabular crystal shape and thickness are maintained during these procedures.

The following ingredients were placed in a suitable reaction vessel:

| Ingredient | Amount (g) |
|---|---|
| Bone gelatin | 8 |
| KCl | 4.1 |
| 4-aminopyrazolo[3,4,d]pyrimidine | 0.08 |
| Deionized water | 500 ml |

Figure 3:
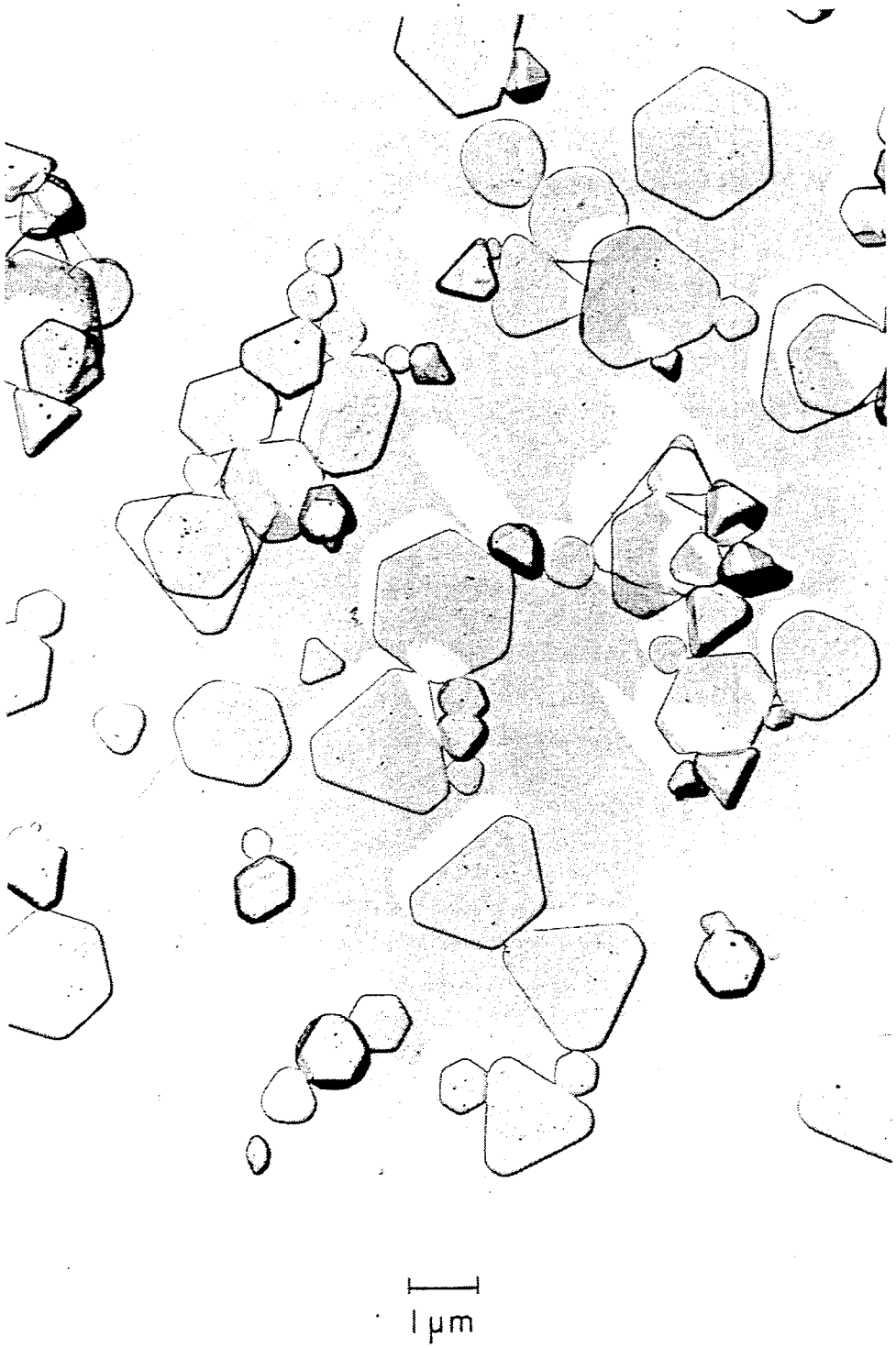
FIG. 3 and FIG. 4 are representative TEM photographs (magnification 9,800 and 9,700, respectively) of carbon-replicated bromide-shelled tabular silver chloride grains prepared according to Example 1 of this invention.

The pH was adjusted with 1.5 M sulfuric acid to 4.0, and the above ingredients were stirred and heated to 60° C. In separate vessels, aqueous solutions of 3.0 M $AgNO_3$ (the silver salt solution) and 3.0 M KCl (the halide salt solution) were prepared. A pump was used to meter each of these solutions into the reaction vessel. In order to generate "seed crystals" on which the remaining grains are to be grown, some of the silver solution was added at 2 ml/minute (single-jet) until the pCl reached a value of 1.0. The silver and halide solutions were then "double-jetted" into the reaction vessel in such a way to maintain the pCl at 1.0. After 10 ml of the silver salt solution had been added, the silver flow rate was increased to 5 ml/minute at a rate of 0.5 ml/minute/minute. After 90 ml of silver solution had been added, double-jet addition continued with the following modification: two ml of a 3 M KBr solution (the second or shell-forming halide salt solution) was pumped at a rate of 1 ml/minute into 8 ml of a 3 M KCl solution with stirring. Simultaneously this chloride solution was delivered continuously into the reaction vessel at 5 ml/minute. The precipitation was stopped when these two halide solutions had been delivered to the reaction vessel in the manner described. Since the bromide concentration changed from 0 to 100% over the last 10% of the grain growth the resulting silver halide grains had an overall composition of $AgCl_{0.98}Br_{0.02}$. These grains were analyzed as described in Control 1 to determine their size and shape. Grains with excellent tabular features, a volume of 0.16 $\mu m^3$, an aspect ratio of 14.3:1, and a thickness of 0.10 μm were obtained, as clearly illustrated in FIG. 3.

Figure 4:
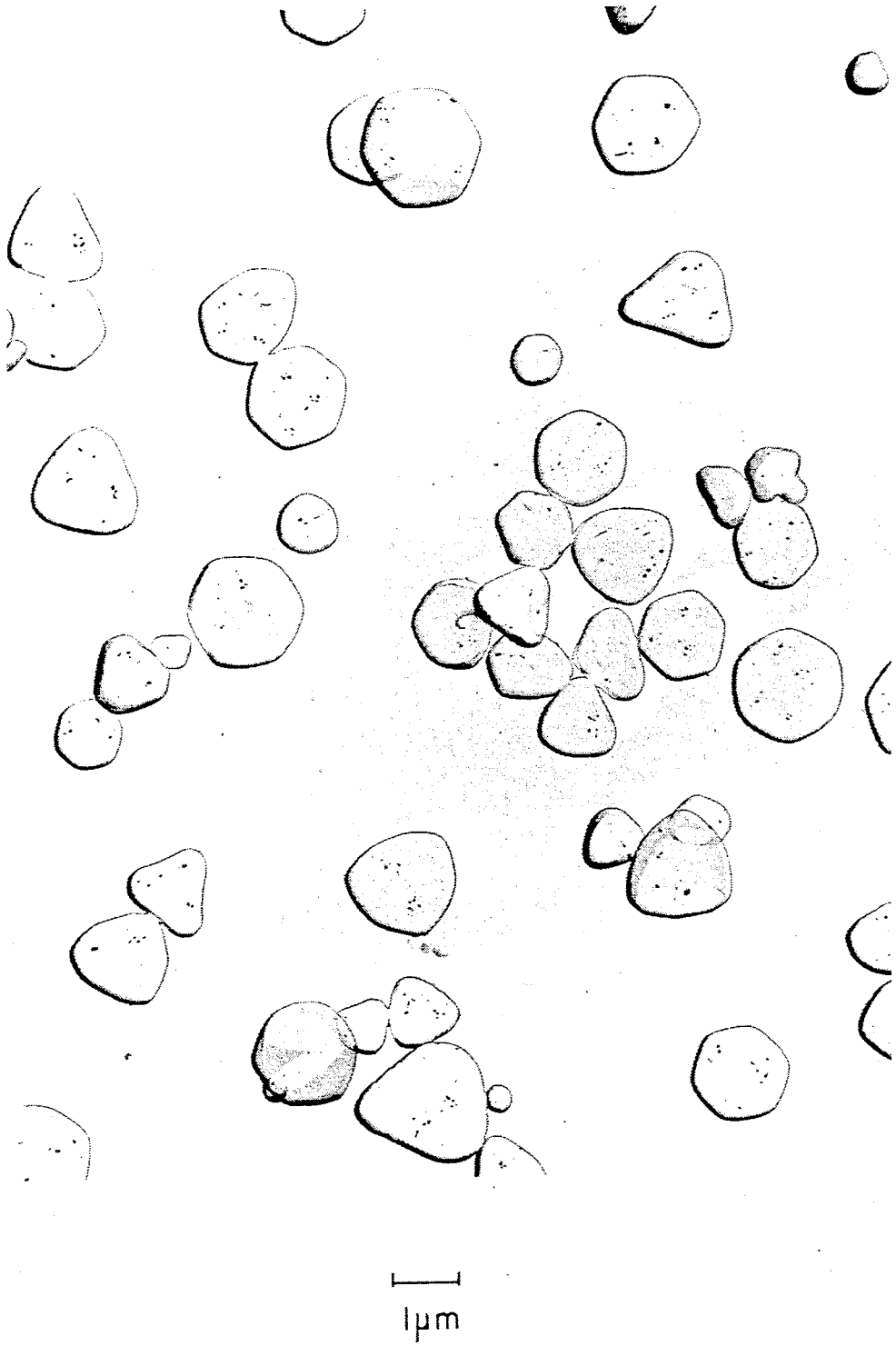

The silver halide precipitation mixture was then desalted and the grains redispersed as described in Control 1. Two portions of the emulsion thus prepared were taken. Portion 1 was coated with about a 2 g/m$^2$ coating weight on a conventional polyethylene terephthalate film support that was coated with a conventional resin sub over which had been applied a gelatin sub layer. Portion 2 was sensitized with conventional gold and sulfur sensitizers and coated as above. Both portions were dried. Samples of each coating were prepared for analysis in the electron microscope as described in Control 1. Excellent tabularity and grain thickness were maintained in both the gold-sulfur sensitized and the unsensitized coated samples. FIG. 4 illustrates the result for the sensitized film sample. Another sample of each coating was given a 0.01 second exposure through a square root of 2 step wedge on an EG&G sensitometer. The exposed samples were then developed for 120 seconds at 28° C. in a standard mixed developer (hydroquinone/phenidone), followed by 15 seconds in a conventional acid stop bath and 60 seconds in a conventional sodium thiosulfate fixer. These samples were washed and dried. The gold-sulfur sensitized film was approximately 1.7 log E unit faster than unsensitized emulsion.

EXAMPLE 2

In this example a high-chloride tabular crystal stabilized as described in Example 1 was used to produce a gold-sulfur sensitized emulsion that was also spectrally sensitized. The same emulsion and sensitization procedure was used except a conventional blue sensitizing zeromethine dye was added as a methanolic solution prior to sensitization at 0.33 gram per mole silver. Coating and evaluation were as described in Example 1. Excellent tabularity and grain thickness were maintained for both the unsensitized and the gold-sulfur-spectrally sensitized film samples. The gold-sulfur-spectrally sensitized film was approximately 2.4 log E unit faster than the unsensitized emulsion.

EXAMPLE 3

This example illustrates another method for introducing a morphologically-stabilizing bromide shell onto tabular high-chloride emulsion grains. Good tabular shape and thickness are maintained when a bromide shell is formed by the controlled addition of a soluble bromide salt solution to the precipitation medium after the grain-forming reaction is complete.

The following ingredients were placed in a suitable reaction vessel:

| Ingredient | Amount (g) |
|---|---|
| Bone gelatin | 30 |
| KCl | 11.2 |
| 3.0 M aqueous KBr | 2.5 ml |
| 4-aminopyrazolo[3,4,d]pyrimidine | 0.4 |
| Deionized water | 1200 ml |

Figure 5:
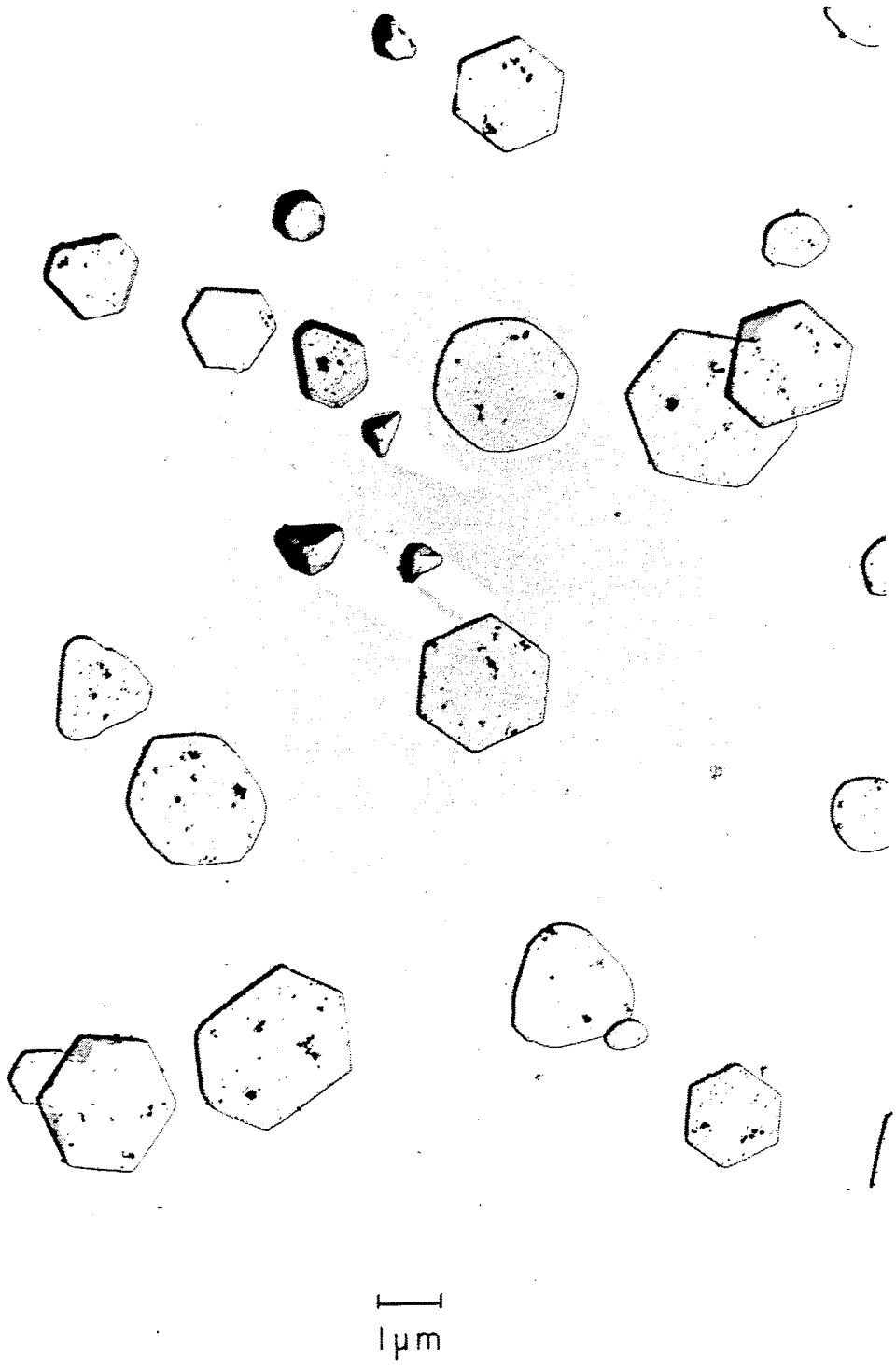
FIG. 5 and FIG. 6 are representative TEM photographs (magnification 8,800) of carbon-replicated bromide-shelled tabular silver bromochloride grains prepared according to Example 3 of this invention.

The precipitation was carried out similarly to the procedure described in Example 1 with the following modifications: the reaction vessel was held at 55° C., the halide salt solution was 2.4 M in KCl and 0.6 M in KBr, single-jet addition of the silver salt solution began at 5 ml/minute and was increased to 10 ml/minute over the course of a five minute ramping sequence after 6% of the silver salt solution had been added. After 1.5 moles of silver halide had been precipitated, silver and halide addition was halted. At this point, 15 ml of 3.0 M KBr solution (the second or shell-forming halide salt solution) was added at 1.5 ml/minute with vigorous stirring. When complete, the precipitation medium was ripened for twenty minutes at constant temperature. The final halide composition of the emulsion grains is $AgCl_{0.76}Br_{0.24}$, assuming complete conversion of the surface layer. The emulsion grains were analyzed as described in Control 1. Excellent tabular grains are formed with a volume of 0.32 $\mu m^3$, an average aspect ratio of 13.6:1 and thickness of 0.13 $\mu$m. FIG. 5 illustrates the resulting emulsion crystals.

Figure 6:
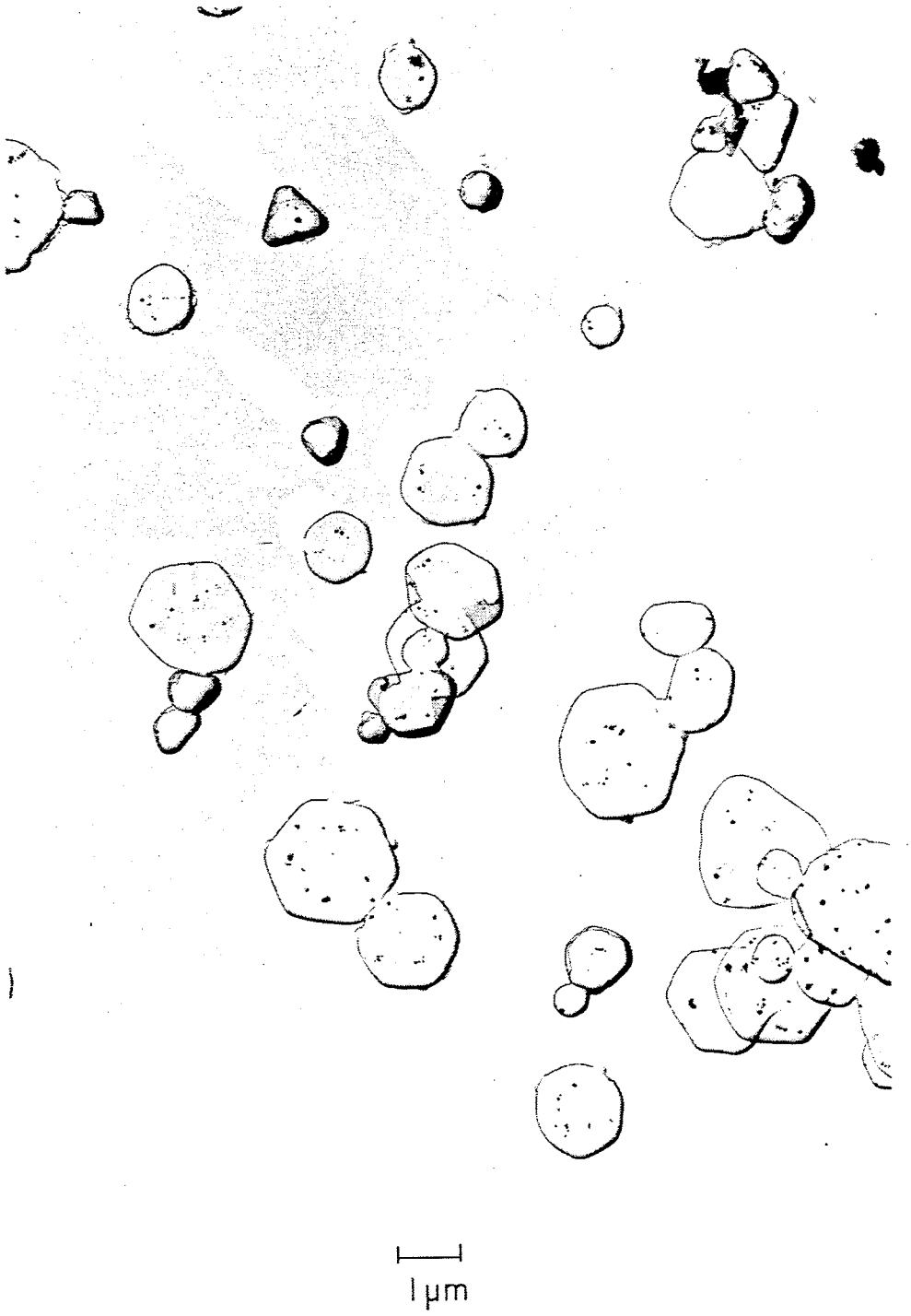

The emulsion grains were then desalted, redispersed and digested as described in Control 1. FIG. 6 illustrates that the addition of the halide shell by the controlled addition of a soluble, shell-forming, halide salt solution preserves the tabular grain characteristics.

EXAMPLE 4

This example illustrates yet another method for introducing a morphologically-stabilizing silver halide shell onto tabular high-chloride emulsion grains. Good tabular shape and thickness are maintained when a silver bromide shell is formed by the controlled double-jet addition of silver and bromide salt solutions to the precipitation medium after the core-forming grain formation reaction is 95% complete.

Figure 7:
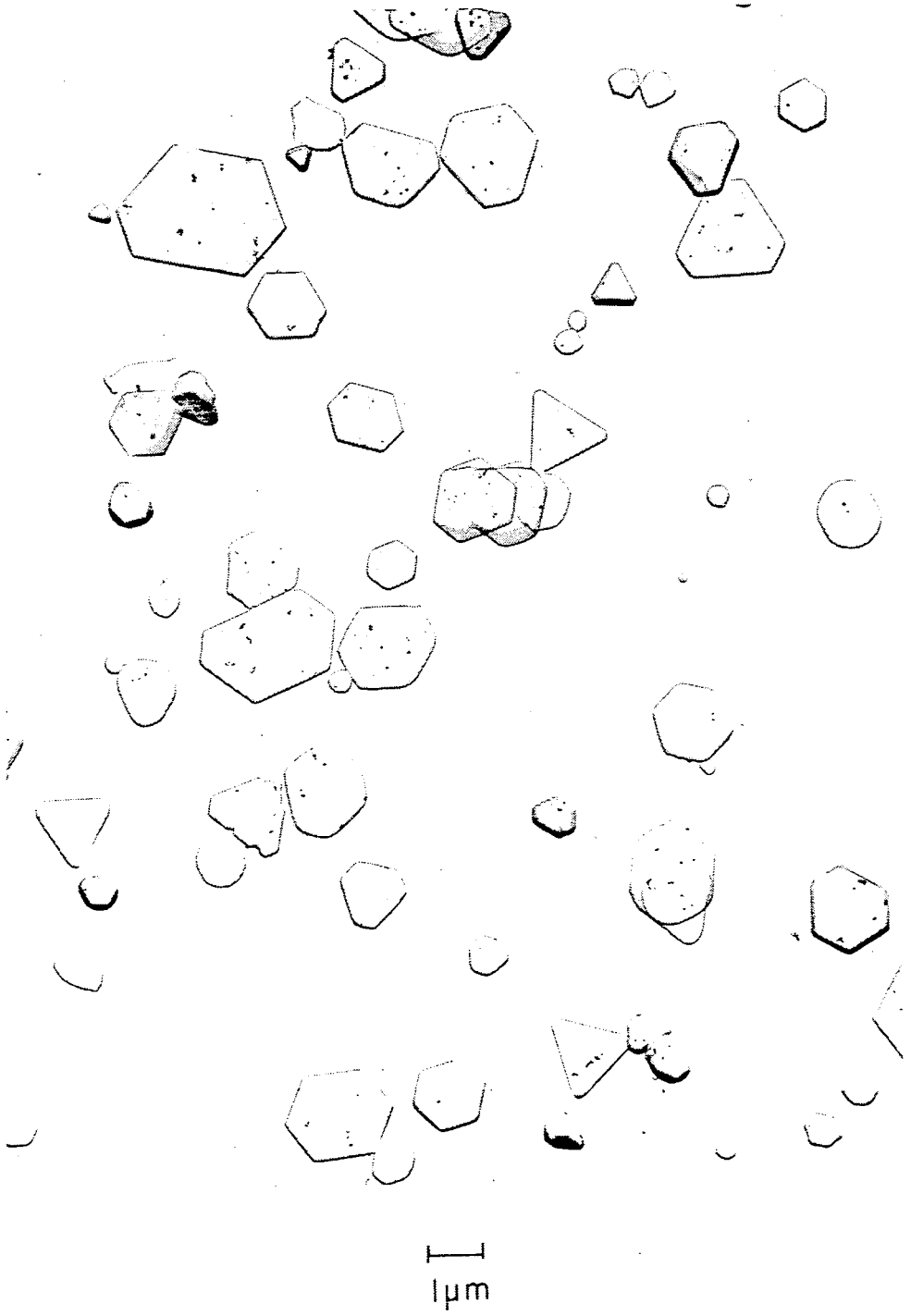
FIG. 7 and FIG. 8 are representative TEM photographs (magnification 7,000) of carbon-replicated bromide-shelled tabular silver bromochloride grains prepared according to Example 4 of this invention.

The ingredients and procedures were identical to those described in Example 3 with the following modifications: the precipitation temperature was 60° C., the core-forming halide salt solution was 2.85 M in KCl and 0.15 M in KBr. After 95% of the silver salt solution had been added, a second or shell-forming halide salt solution, composed of 25 ml of 3.0 M KBr solution, was "double-jetted" with the remainder of the silver salt solution at a reduced flow rate of 2.0 ml/minute. A total of 1.5 moles of silver halide was precipitated with the overall halide composition of the emulsion grains being $AgCl_{0.895}Br_{0.105}$. The emulsion grains were analyzed as described in Control 1. Excellent tabular grains were formed with a volume of 0.26 $\mu m^3$, an average aspect ratio of 8.2:1 and thickness of 0.17 $\mu$m. FIG. 7 illustrates the resulting emulsion crystals.

Figure 8:
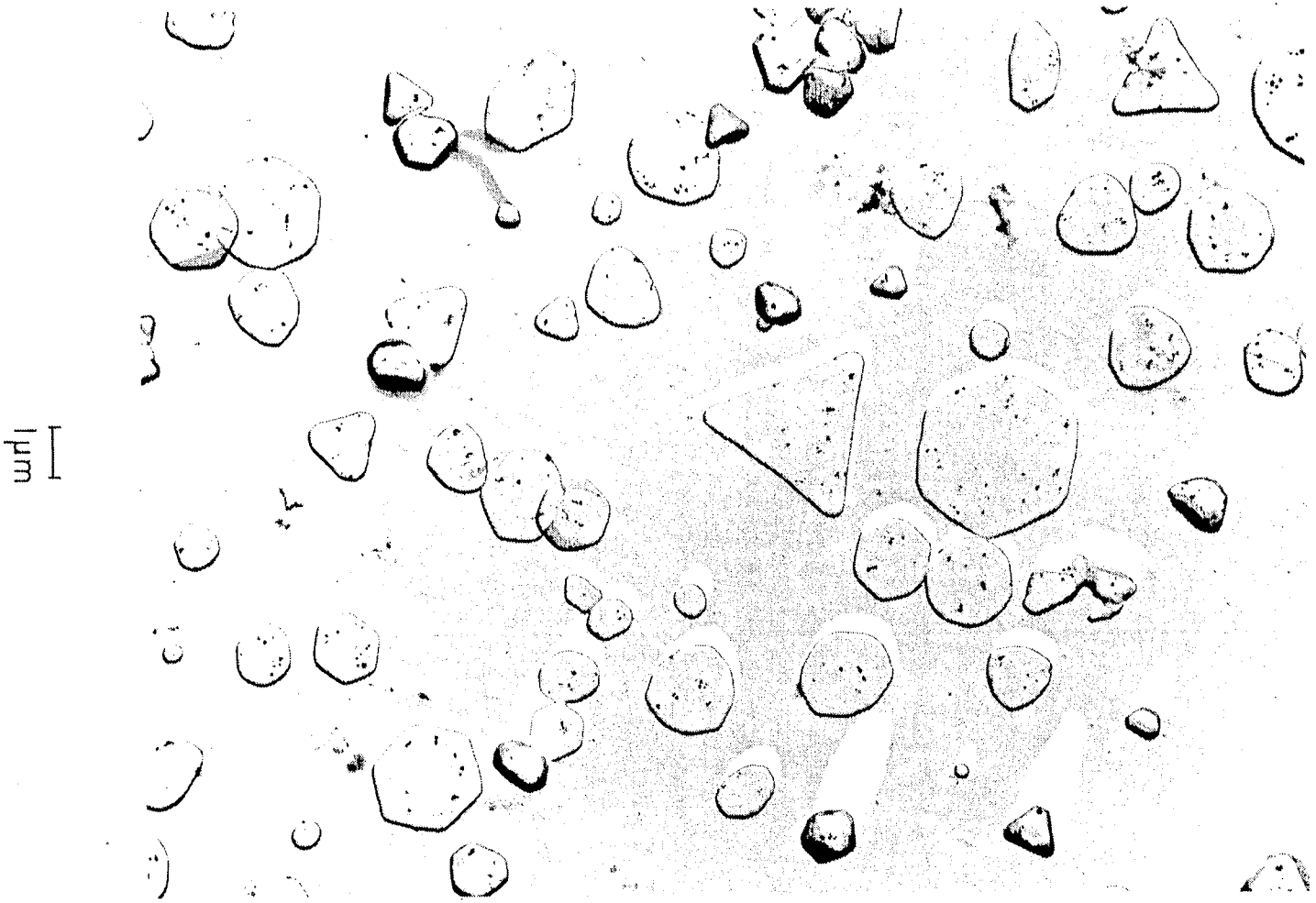

The emulsion grains were then desalted, redispersed and digested as described in Control 1. FIG. 8 illustrates that the addition of the halide shell by the controlled double-jet addition of silver and shell-forming halide salt solutions preserves the excellent tabular grain characteristics.

EXAMPLE 5

In this example, a silver iodide shell is formed on a silver bromochloride core by the single-jet addition of a soluble iodide salt solution after the grain formation reaction is complete.

The ingredients and procedures were identical to those described in Example 3 with the following modifications: the second or shell-forming halide salt solution was 10 ml of 3.0 M KI solution. This was added to the mixing vessel at 1.0 ml/minute. When complete, the precipitation mixture was ripened for ca. 20 minutes at constant temperature. The resulting emulsion grains had an overall composition of $AgCl_{0.775}Br_{0.205}I_{0.02}$. Analysis revealed that excellent tabular grains had been formed with a volume of 0.26 $\mu m^3$, an aspect ratio of 13.8:1, and a thickness of 0.12 $\mu$m. The emulsion was desalted, redispersed and sensitized as described in Control 1. Subsequent inspection of the grains showed that excellent tabular characteristics had been maintained.

CONTROL 2

In this control, octahedral high-chloride emulsion grains, prepared by the delayed addition of a pH-sensitive grain growth modifying agent are shown to be morphologically unstable during preparation steps commonly employed in the sensitization and coating of a photographic film when not stabilized by the process of this invention.

The following ingredients were placed in a suitable reaction vessel:

| Ingredient | Amount (g) |
|---|---|
| Bone Gelatin | 30.0 g |
| KCl | 13.4 g |
| Deionized water | 1200 ml |

The pH was adjusted to 4.0 with 1.5 M sulfuric acid, and the above ingredients were stirred and heated to 60° C. In separate vessels, aqueous solutions of 3.0 M $AgNO_3$ (the silver salt solution) and 3.0 M KCl (the halide salt solution) were prepared. A pump was used to meter each of these solutions into the reaction vessel. In order to generate "seed crystals" on which the remaining grains are grown, some of the silver solution was added at 5 ml/minute (single-jet) until the pCl reached a value of 1.0. The silver and halide solutions were then "double-jetted" into the reaction vessel in a manner to maintain the pCl at 1.0. When 6% of the silver salt solution had been delivered, the silver flow rate was increased at a rate of 1 ml/minute until a flow rate of 10 ml/minute was attained. At the point where approximately 20% of the silver salt solution had been added, an aqueous acidic solution of pH 4 and containing 0.4 gram 4-aminopyrazolo[3,4,d]pyrimidine was added. The precipitation reaction continued until 500 ml of the silver salt solution had been added. The resulting AgCl grains were analyzed as described in Control 1 for grain size and shape immediately after the growth phase of the precipitation was complete. Well-formed octahedral grains with a median diameter of 0.26 $\mu$m and a volume of 0.070 $\mu m^3$ were obtained.

The grains were then desalted, redispersed, digested and coated as described in Example 1. Electron micrographs of a sample showed that the emulsion grains had become rounded and distorted, losing their well-defined octahedral features.

EXAMPLE 6

In this example, high-chloride {111} octahedral emulsion grains are morphologically stabilized throughout the steps normally used to prepare an emulsion for sensitization and coating by the addition of a graded bromide shell at the end of the precipitation process. Well-defined octahedral crystal morphology is maintained during these procedures.

A high-chloride octahedral emulsion was prepared as described in Control 2 with the following modifications: during the last 30 ml of double-jet addition, 15 ml of a 3.0 M KBr solution were pumped into 15 ml of the core-forming halide salt solution at 5 ml/minute with stirring while the halide salt solution was in turn being added to the reaction vessel at 10 ml/minute. Since the bromide concentration changed from 0 to 100% over the last 6% of grain growth, the resulting silver halide grains had an overall composition of $AgCl_{0.97}Br_{0.03}$. The grains were desalted, redispersed, digested, and coated as described in Example 1. Samples examined in the electron microscope at the end of precipitation and prepared from coated films of the same emulsion showed that excellent octahedral morphology was maintained. Sulfur-gold and sulfur-gold-dye sensitizations and coatings were carried out on portions of the emulsion as described previously. The sulfur-gold and sulfur-gold-dye sensitized samples were approximately 2.0 and 2.3 log E units faster than an unsensitized film sample, respectively.

We claim:

1. A process for stabilizing the crystalline grain morphology of a radiation sensitive photographic emulsion by bringing into contact, in a vessel in the presence of a dispersing medium and a crystal modifying amount of an aminoazapyridine growth modifying agent at a pH in the range of 2.5 to 9.0 and a pCl in the range of 0 to 3, aqueous silver and chloride-containing salt solutions to precipitate silver halide grain cores wherein at least 50% of the total projected area of the total grain population precipitated are noncubic silver halide grain cores, and wherein the halide content of the silver halide emulsion is at least 50 mole percent chloride, based on the total moles of silver precipitated, the improvement wherein subsequent to the addition of at least 60 percent of the aqueous silver salt solution to the vessel based on the total moles of silver precipitated introducing at a gradual rate of addition a second or shell-forming halide salt solution which is nonchloride-rich to the chloride-containing salt solution to form a halide salt solution mixture, the composition of the halide salts in said mixture continuously changing from 0 to 100% concentration of said second or shell-forming halide salt solution which is added in an amount such that a shell of 0.5 to 20 mole % based on the final total moles of silver precipitated, is formed surrounding the chloride-containing grain core.

2. A process according to claim 1 wherein the delivery of the chloride-containing halide salt solution is stopped after at least 80% of the total grain formation reaction is complete and the second or shell-forming halide salt solution is added in a gradual rate of addition directly to the reaction vessel whereby grain formation is occurring in an amount of 0.5 to 20 mole % based on the total moles of silver precipitated.

3. A process according to claim 2 wherein the gradual rate of addition is 0.01 to 0.5 times the maximum rate of addition of the silver salt solution used during the core-forming grain formation reaction.

4. A process according to claim 1 wherein the halide salt solution forming the shell on the chloride-containing grain core is bromide, iodide, chlorobromide, and combinations thereof.

5. A process according to claim 1 wherein the aminoazapyridine growth modifying agent is of the formula:

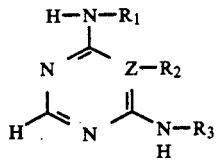

wherein Z is C or N; $R_1$, $R_2$ and $R_3$, which may be the same or different, are H or alkyl of 1 to 5 carbon atoms; when Z is C, $R_2$ and $R_3$ when taken together can be $—CR_4{=}CR_{50}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together is said $—CR_4{=}N—$, $—CR_4{=}$ must be joined to Z; and salts thereof.

6. A process according to claim 5 wherein the aminoazapyridine compound is 4-aminopyrazolo[3,4,d-]pyrimidine.

7. A process according to claim 5 wherein the aminoazapyridine compound is 4,6-diaminopyrimidine hemisulfate monohydrate.

8. A process according to claim 5 wherein the aminoazapyridine compound is 2,4-diamino-1,3,5-triazine.

9. A process according to claim 5 wherein the aminoazapyridie compound is 4,6-bis(methylamino)-pyrimidine.

10. A process according to claim 5 wherein the aminoazapyridine compound is present in an amount of 0.0001 to 1.0 mole percent based on the total moles of silver precipitated.

11. A process according to claim 5 wherein the aminoazapyridine compound is present in an amount of 0.05 of 0.5 mole percent based on the total moles of silver precipitated.

12. A process according to claim 1 wherein the dispersing medium is gelatin.

13. A process according to claim 1 wherein the silver halide emulsion is a silver bromochloride emulsion, the bromide constituent being present in a maximum amount of 49 mole percent.

14. A process according to claim 1 wherein the silver halide emulsion is a silver iodobromochloride emulsion, the bromide and iodide constituent being present in a maximum amount of 48 and 2 mole percent, respectively.

15. A process according to claim 1 wherein the grains are formed at a pCl of 0.3 to 1.7 and a pH in the range of 3.5 to 8.0.

* * * * *

UNITED STATES PATENT AND TRADEMARK OFFICE

CERTIFICATE OF CORRECTION

PATENT NO. : 5,035,992

DATED : JULY 30, 1991

INVENTOR(S) : WILLIAM ANTHONY HOULE/THOMAS PETER TUFANO

It is certified that error appears in the above—identified patent and that said Letters Patent is hereby corrected as shown below:

Column 14, line 15,"$-CR_4=CR_{50}CR_5-$" should be -- $-CR_4=CR_5-$ --.

Signed and Sealed this

Twelfth Day of January, 1993

*Attest:*

DOUGLAS B. COMER

*Attesting Officer*

*Acting Commissioner of Patents and Trademarks*